US012221703B2

(12) United States Patent
Strock et al.

(10) Patent No.: US 12,221,703 B2
(45) Date of Patent: Feb. 11, 2025

(54) SOLUTION BASED CORROSION INHIBITORS FOR ALUMINUM ALLOY THERMAL SPRAY COATINGS

(71) Applicant: Raytheon Technologies Corporation, Farmington, CT (US)

(72) Inventors: Christopher W. Strock, Kennebunk, ME (US); William J. Joost, Worcester, MA (US); Promila P. Bhaatia, Farmington, CT (US)

(73) Assignee: RTX Corporation, Farmington, CT (US)

( * ) Notice: Subject to any disclaimer, the term of this patent is extended or adjusted under 35 U.S.C. 154(b) by 860 days.

(21) Appl. No.: 17/273,845

(22) PCT Filed: Sep. 20, 2019

(86) PCT No.: PCT/US2019/052106

§ 371 (c)(1),
(2) Date: Mar. 5, 2021

(87) PCT Pub. No.: WO2020/061427

PCT Pub. Date: Mar. 26, 2020

(65) Prior Publication Data

US 2021/0348278 A1 Nov. 11, 2021

Related U.S. Application Data

(60) Provisional application No. 62/734,883, filed on Sep. 21, 2018.

(51) Int. Cl.
*C23C 22/30* (2006.01)
*C23C 4/08* (2016.01)
(Continued)

(52) U.S. Cl.
CPC ..... *C23C 22/34* (2013.01); *C23C 4/08* (2013.01); *C23C 4/129* (2016.01); *C23C 4/18* (2013.01);
(Continued)

(58) Field of Classification Search
CPC ..... C23C 2222/10; C23C 22/24–33
See application file for complete search history.

(56) References Cited

U.S. PATENT DOCUMENTS 6,089,825 A 7/2000 Walden et al.
6,669,764 B1 12/2003 Matzdorf et al.
(Continued)

FOREIGN PATENT DOCUMENTS

EP 1378585 B2 4/2017
WO 2010/112914 A1 10/2010

OTHER PUBLICATIONS

Material Product Data Sheet: "Aluminum Silicon Polymer Thermal Spray Powders", Sep. 2017, Oerlikon Surface Solutions AG, Pfäffikon, Switzerland.

(Continued)

*Primary Examiner* — Lois L Zheng
(74) *Attorney, Agent, or Firm* — Bachman & LaPointe, P.C.

(57) ABSTRACT

A method (400) for applying a coating to a substrate (124) includes spraying (414) an aluminum-based coating layer (120) on the substrate. The coating layer is then infiltrated (420) with an aqueous solution (610). The solution comprises: a source of chromium; and potassium hexafluorozirconate.

20 Claims, 8 Drawing Sheets

(51) Int. Cl.

| | |
|---|---|
| ***C23C 4/129*** | (2016.01) |
| ***C23C 4/18*** | (2006.01) |
| ***C23C 22/34*** | (2006.01) |
| ***C23C 22/76*** | (2006.01) |
| ***C23C 22/82*** | (2006.01) |
| *C23C 22/24* | (2006.01) |
| *C23C 22/56* | (2006.01) |
| *F01D 5/28* | (2006.01) |

(52) U.S. Cl.
CPC ..... *C23C 22/76* (2013.01); *C23C 22/82* (2013.01); *C23C 2222/10* (2013.01); *F01D 5/282* (2013.01); *F01D 5/288* (2013.01)

(56) References Cited

U.S. PATENT DOCUMENTS

| | | | |
|---|---|---|---|
| 7,018,486 | B2 | 3/2006 | Bhatia |
| 7,357,068 | B2 | 4/2008 | Barbezat |
| 9,487,866 | B2 | 11/2016 | Kramer et al. |
| 9,528,008 | B2 | 12/2016 | Strock et al. |
| 9,534,120 | B2 | 1/2017 | Matzdorf et al. |
| 9,896,756 | B2 | 2/2018 | Beaudion et al. |
| 2009/0090298 | A1 | 4/2009 | King et al. |
| 2013/0065066 | A1 | 3/2013 | Sambasivan et al. |
| 2016/0017501 | A1 | 1/2016 | Strock |
| 2016/0251975 | A1 | 9/2016 | Strock et al. |

OTHER PUBLICATIONS

"Metco® 601NS Aluminum-Polyester Powder", Technical Bulletin #10-141, Oct. 2000, Oerlikon Surface Solutions AG, Pfäffikon, Switzerland.

Conference presentation: "Overview of Sulzer Metco Compressor and Turbine Abradable Technology", Sep. 2011, Sulzer Metco, 8th International Charles Parsons Turbine Conference, Portsmouth, United Kingdom.

International Search Report and Written Opinion dated Dec. 4, 2019 for PCT Patent Application No. PCT/US19/52106.

Craig Matzdorf et al., "Non-Chromate Aluminum Pretreatments", ESTCP Phase I Report, Aug. 1, 2003, Naval Air Systems Command, Patuxent River, Md.

European Search Report dated May 16, 2022 for European Patent Application No. 19863165.7.

SOLUTION BASED CORROSION INHIBITORS FOR ALUMINUM ALLOY THERMAL SPRAY COATINGS

CROSS-REFERENCE TO RELATED APPLICATIONS

Benefit is claimed of U.S. Patent Application No. 62/734,883, filed Sep. 21, 2018, and entitled "Solution Based Corrosion Inhibitors for Aluminum Alloy Thermal Spray Coatings", the disclosures of which are incorporated by reference herein in their entireties as if set forth at length.

BACKGROUND

The disclosure relates to turbomachines. More particularly, the disclosure relates to aluminum-based abradable coatings.

Gas turbine engines include fans and compressor rotors having a plurality of rotating blades. Minimizing the leakage of air, such as between tips of rotating blades and a casing of the gas turbine engine increases the efficiency of the gas turbine engine because the leakage of air over the tips of the blades can cause aerodynamic efficiency losses. To minimize this, gaps at tips of the blade are set small and, under certain conditions, the blade tips may rub against and engage an abradable seal at the casing of the gas turbine engine (e.g., along the inner diameter (D) surface of a blade outer air seal (BOAS)). The abradability of the seal material prevents damage to the blades while the seal material itself wears to generate an optimized mating surface and thus reduce the leakage of air. Similar considerations attend the relationship between inner diameter tips of cantilevered vane airfoil and a rotor outer diameter (OD) surface bearing an abradable seal material.

Examples of aluminum-based abradable coatings are Al—Si alloys such as plasma-sprayed Metco® 601NS aluminum-polyester powder, Oerlikon Surface Solutions AG, Pfaffikon, Switzerland (60 wt. percent Al12Si, balance polyester). The polyester acts as a fugitive porosity former forming porosity in the sprayed coating. A further development is seen in U.S. Pat. No. 6,089,825, Walden et al., Jul. 18, 2000, and entitled "Abradable seal having improved properties and method of producing seal" (the '825 patent), the disclosure of which is incorporated by reference herein its entirety as if set forth at length.

Aluminum-based abradable coatings that are used in fan and compressor applications are prone to aqueous corrosion. The coatings are porous and absorb water that subsequently dries during use. When this process is repeated, contaminants in the water concentrate and can produce a conductive and corrosive electrolyte, while water is present. The conductive water trapped within the porosity of the coating results in an increased tendency for internal corrosion or crevice corrosion. The result is that the coating becomes weaker, has reduced ductility, loses its abradable characteristics, and can spall and compromise performance/efficiency and damage airfoils.

United States Patent Application Publication 20160251975A1, Strock et al., Sep. 1, 2016, entitled "Aluminum Alloy Coating with Rare Earth and Transition Metal Corrosion Inhibitors" (the '975 publication), the disclosure of which is incorporated by reference herein its entirety as if set forth at length, discloses Ce, Co, Mo, W, or V metal compounds and mixtures thereof as corrosion inhibitors in aluminum-based abradable coatings.

SUMMARY

One aspect of the disclosure involves a method for applying a coating to a substrate. The method comprises: spraying an aluminum-based coating layer on the substrate; and infiltrating the coating layer with an aqueous solution. The solution comprises: a source of chromium; and potassium hexafluorozirconate.

A further embodiment of any of the foregoing embodiments may additionally and/or alternatively include the source of chromium being a source of trivalent chromium.

A further embodiment of any of the foregoing embodiments may additionally and/or alternatively include the source of chromium comprising at least one of: chromium sulfate, chromium nitrate, and chromium fluoride.

A further embodiment of any of the foregoing embodiments may additionally and/or alternatively include the infiltrated solution causing a reaction forming oxides of aluminum, chromium, and zirconium.

A further embodiment of any of the foregoing embodiments may additionally and/or alternatively include the substrate is a turbomachine component and the coating being in sliding engagement with another turbomachine component.

A further embodiment of any of the foregoing embodiments may additionally and/or alternatively include the infiltrating comprising directing a jet of the solution to the coating layer.

A further embodiment of any of the foregoing embodiments may additionally and/or alternatively include the directing comprising sweeping the jet over a surface of the component.

A further embodiment of any of the foregoing embodiments may additionally and/or alternatively include the directing comprising sweeping the jet over a surface of the component from a nozzle sliding along the surface.

A further embodiment of any of the foregoing embodiments may additionally and/or alternatively include the infiltrating comprising vacuum infiltration.

A further embodiment of any of the foregoing embodiments may additionally and/or alternatively include the aqueous solution comprising 120-1500 ppm zirconium from potassium hexafluorozirconate.

A further embodiment of any of the foregoing embodiments may additionally and/or alternatively include the aqueous solution comprising 80-1000 ppm chromium (III) concentration combined from at least one of chromium sulfate, chromium nitrate, and chromium fluoride.

A further embodiment of any of the foregoing embodiments may additionally and/or alternatively include the aqueous solution comprising: 80-1000 ppm chromium (III) concentration combined from at least one of chromium sulfate, chromium nitrate, and chromium fluoride; and 120-1500 ppm zirconium.

A further embodiment of any of the foregoing embodiments may additionally and/or alternatively include the coating having: a porosity before infiltration; and a porosity after drying no more than 1% volume percent less than the porosity before infiltration.

Another aspect of the disclosure involves a method for corrosion protecting an aluminum-based coating on a substrate. The method comprising: infiltrating the coating with an aqueous solution of: a source of chromium; and potassium hexafluorozirconate.

A further embodiment of any of the foregoing embodiments may additionally and/or alternatively include the source of chromium being a source of trivalent chromium.

A further embodiment of any of the foregoing embodiments may additionally and/or alternatively include the aqueous solution comprising: 80-1000 ppm chromium (III) concentration combined from at least one of chromium sulfate, chromium nitrate, and chromium fluoride; and 120-1500 ppm zirconium.

Another aspect of the disclosure involves an article comprising a substrate. An aluminum-based coating layer is on the substrate and has porosity. A conversion coating is along surfaces of the porosity and comprises oxides of aluminum, chromium, and zirconium.

A further embodiment of any of the foregoing embodiments may additionally and/or alternatively include the conversion coating being 90 to 100 weight percent said oxides of aluminum, chromium, and zirconium.

A further embodiment of any of the foregoing embodiments may additionally and/or alternatively include the substrate being selected from the group consisting of stainless steels, titanium alloys, and aluminum alloys;

A further embodiment of any of the foregoing embodiments may additionally and/or alternatively include the substrate being a turbine engine component.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

As is discussed below, an exemplary process involves spray application of an abradable coating material ultimately leaving porosity. Thereafter, the porous coating is infiltrated with a corrosion inhibitor.

Figure 1:
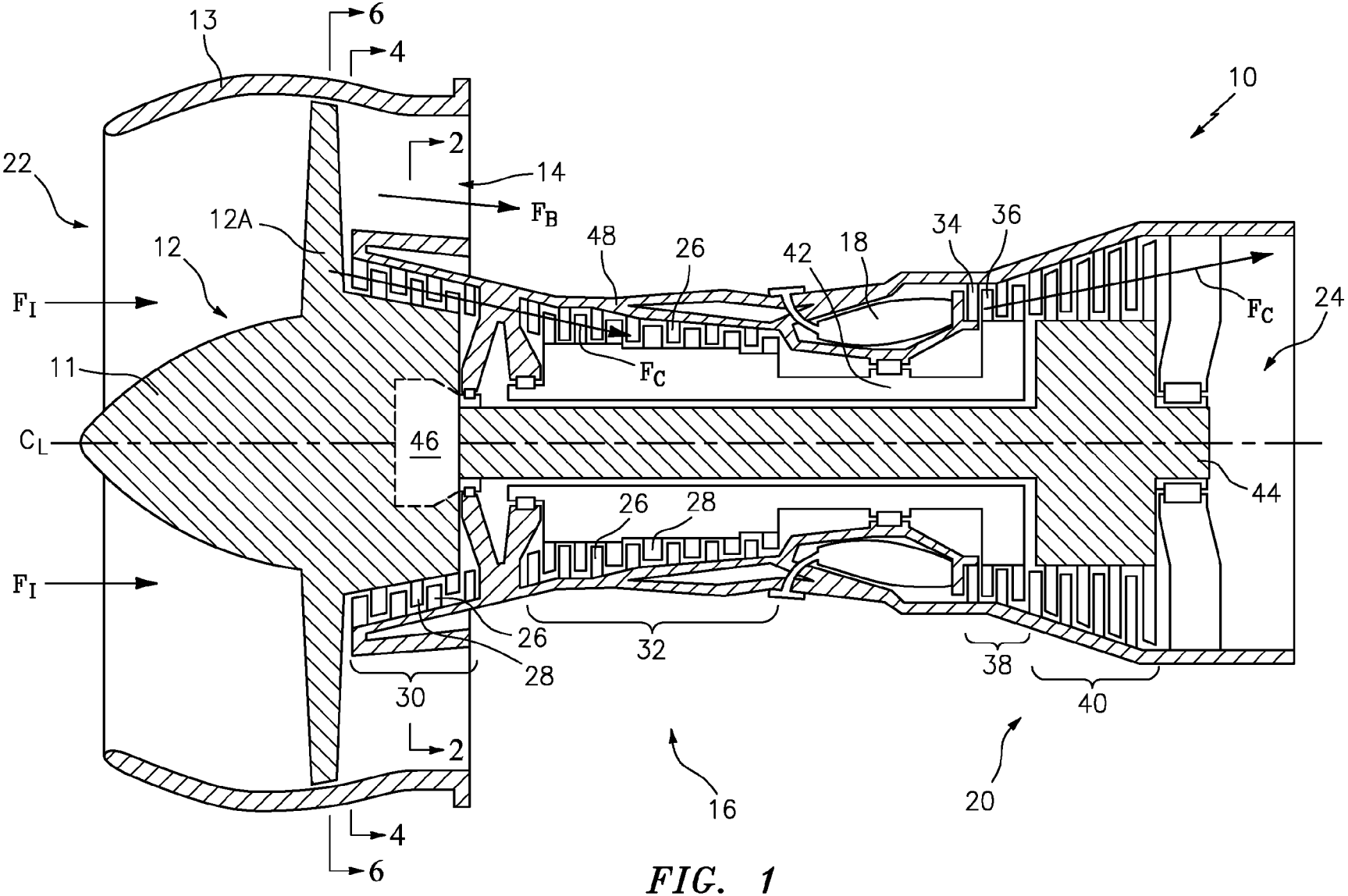
FIG. 1 is a simplified cross-sectional view of a gas turbine engine.

FIG. 1 is a cross-sectional view of gas turbine engine 10 (schematically shown as a turbofan taken from the '975 publication). As shown in FIG. 1, turbine engine 10 comprises fan 12 positioned in bypass duct 14, with bypass duct 14 oriented about a turbine core comprising compressor section 16, combustor (or combustors) 18, and turbine section 20, arranged in flow series with upstream inlet 22 and downstream exhaust stream 24.

Compressor 16 comprises stages of compressor vanes 26 and blades 28 arranged in low pressure compressor (LPC) section 30 and high pressure compressor (HPC) section 32. Turbine 20 comprises stages of turbine vanes 34 and turbine blades 36 arranged in high pressure turbine (HPT) section 38 and low pressure turbine (LPT) section 40. HPT Section 38 is coupled to HPC section 32 via HPT shaft 42, forming the high pressure spool or high spool. LPT section 40 is coupled to LPC Section 30 and fan 12 via LPT shaft 44, forming the low pressure spool or low spool. HPT shaft 42 and LPT shaft 44 are typically coaxially mounted, with the high and low spools independently rotating about turbine axis ($C_L$.).

Fan 12 comprises a number of fan blade airfoils 12A circumferentially arranged around a fan hub 11 or other rotating member in fan shroud 13. Fan hub 11 is coupled directly or indirectly to LPC section 30 and driven by LPT shaft 44. In some embodiments, fan hub 11 is coupled to the low spool via geared fan drive mechanism 46, providing reduced fan speed.

Fan 12 is forward mounted and provides thrust by accelerating flow downstream through bypass duct 14, for example, in a high bypass configuration suitable for commercial and regional jet aircraft operations.

Alternatively, fan 12 may be an unducted fan or propeller assembly, in either a forward or aft mounted configuration. In these various embodiments, turbine engine 10 comprises any of a high bypass turbofan, a low bypass turbofan or a turbo prop engine, in which the number of spools and shaft configurations may vary. In operation of turbine engine 10, incoming airflow $F_I$ enters fan inlet 22 and divides into core flow $F_C$ and bypass flow $F_B$ downstream of the fan blades. Core flow $F_C$ passes along the core flowpath through compressor section 16, combustor 18, and turbine section 20 and bypass flow $F_E$ passes along the bypass flowpath through bypass duct 14. LPC section 30 and HPC section 32 of compressor 16 are utilized to compress incoming air for combustor 18 where fuel is introduced, mixed with air and ignited to produce hot combustion gas. Depending on embodiment, fan 12 also provides some degree of compression (or pre-compression) to core flow $F_C$ and LPC section 30 (or a portion of it) may be omitted. Alternatively, an additional intermediate spool may be included, for example, in a three-spool turboprop or turbofan configuration.

Combustion gas exits combustor 18 and enters HPT (section 38) of turbine 20, encountering turbine vanes 34 and turbine blades 36. Turbine vanes 34 turn and accelerate the flow, and turbine blades 36 generate lift for conversion to rotational energy via HPT shaft 42, driving HPC section 32 of compressor 16 via HPT shaft 42. Partially expanded combustion gas transitions from HPT section 38 to LPT section 40, driving LPC section 30 and fan 11 via LPT shaft 44. Exhaust flow exits LPT section 40 and turbine engine 10 via exhaust nozzle 24.

The thermodynamic efficiency of turbine engine 10 is tied to the overall pressure ratio as defined between the delivery pressure at inlet 22 and the compressed air pressure entering combustor 18 from compressor section 16. In general, a higher pressure ratio offers increased efficiency and improved performance including greater specific thrust. High pressure ratios also result in increased peak gas path temperatures, higher core pressure, and greater flow rates, increasing thermal and mechanical stress on engine components.

Figure 2:
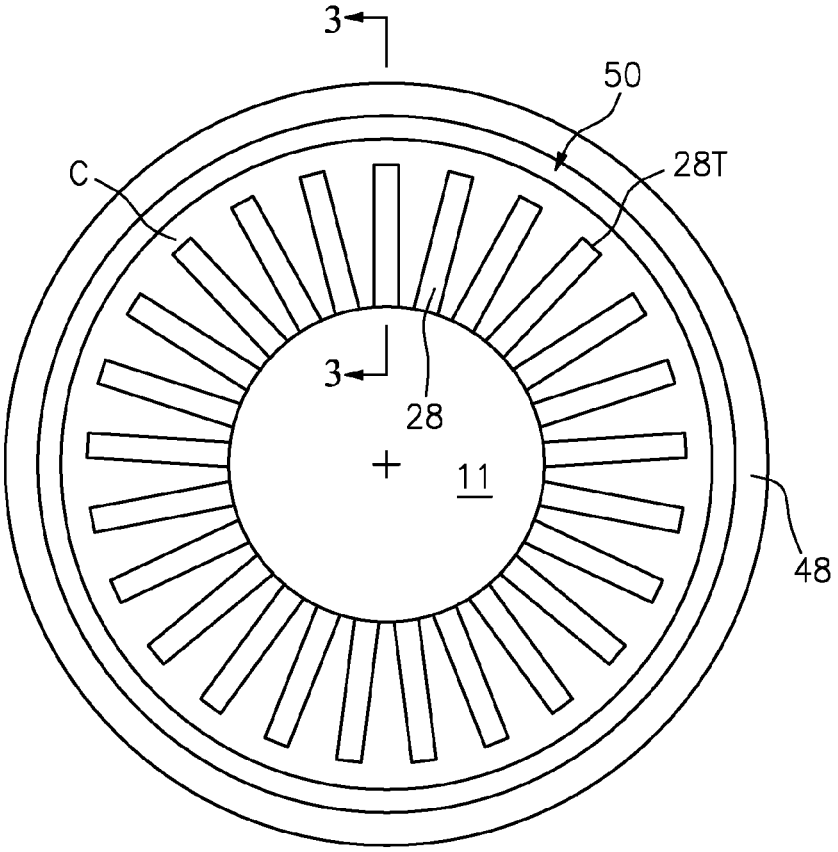
FIG. 2 is a cross-sectional view illustrating the relationship of a casing or shroud and compressor blades taken along the line 2-2 of FIG. 1, not to scale.
Figure 3A:
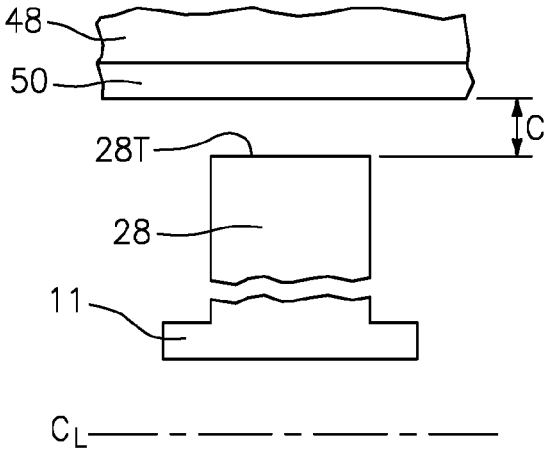
FIG. 3A is a cross-sectional view taken along the line 3-3 of FIG. 2, of a casing or shroud and compressor blade not to scale.
Figure 3B:
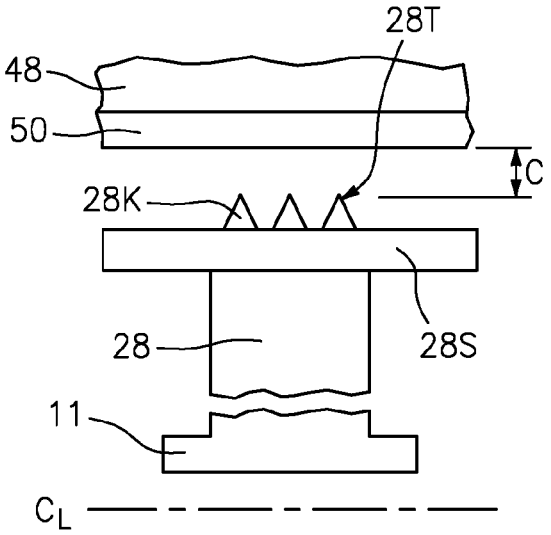
FIG. 3B is a cross-sectional view taken along the line 3-3 of FIG. 2 of a casing or shroud and alternate compressor blade having a knife edge seal, not to scale.
Figure 4:
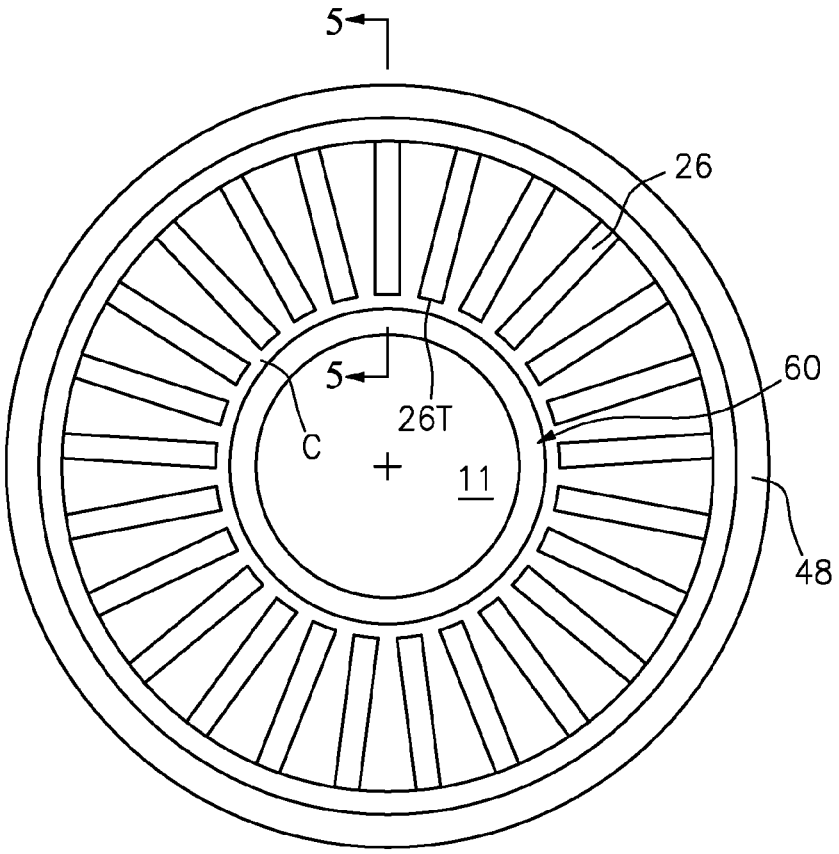
FIG. 4 is a cross-sectional view illustrating the relationship between rotor and compressor vanes taken along the line 4-4 of FIG. 1, not to scale.
Figure 5A:
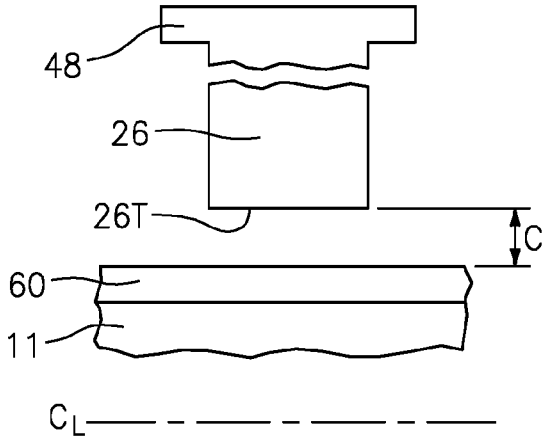
FIG. 5A is a cross-sectional view taken along the line 5-5 of FIG. 4, of a rotor and compressor vane, not to scale.
Figure 5B:
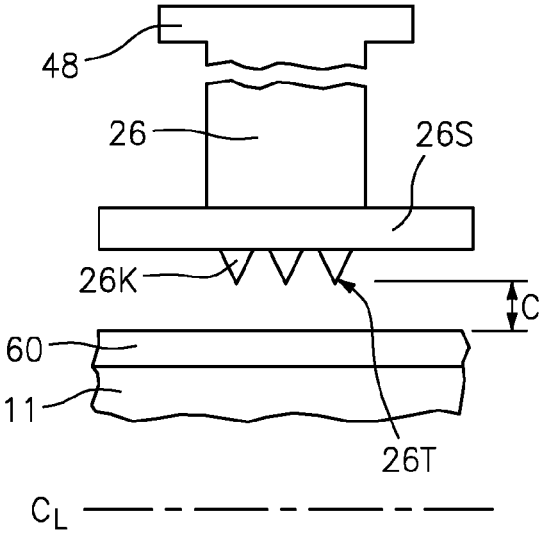
FIG. 5B is a cross-sectional view taken along the line 5-5 of FIG. 4 of a rotor and alternate vane having a knife seal, not to scale.
Figure 6:
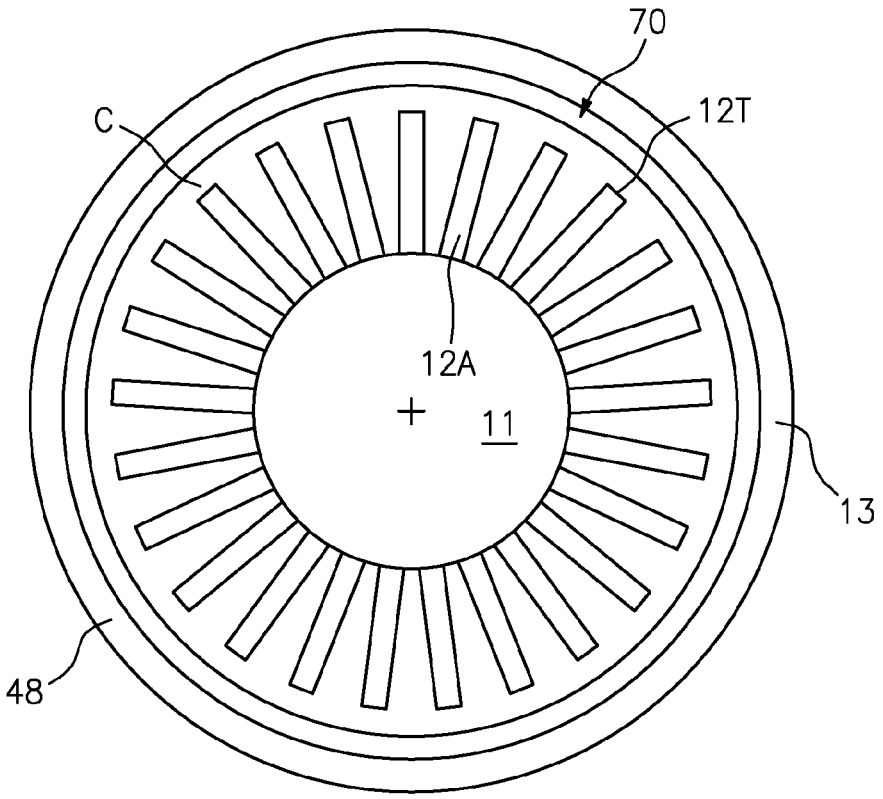
FIG. 6 is a cross-sectional view of a fan shroud and fan blades taken along the line 6-6 of FIG. 1, not to scale.

FIGS. 2, 3A and 3B show a relationship of a rotor blade or fan blade with a stationary casing or shroud. FIGS. 4, 5A and 5B show an interaction of a stator vane with a rotor (e.g., a spacer between blade stages or a hub). FIG. 6 shows a relationship of a fan blade and fan shroud. The coatings disclosed may be used with these configurations and others known in the art.

FIG. 2 is a cross-section along line 2-2 in FIG. 1 through the LPC section and showing an LPC rotor inside casing 48. The clearance between blades 28 and casing 48 is indicated by C. Abradable coating 50 is on the inner diameter (ID) surface of casing 48 such that the clearance between blade tips 28T of blades 28 and coating 50 has the proper tolerance for operation of the engine (e.g., to serve as a seal to prevent leakage of air (thus increasing efficiency)) while not interfering with the relative movement of the blades and the casing 48.

In FIG. 2 and FIGS. 3A and 3B (showing two different blade variations), clearance C is expanded for purpose of illustration. In practice, clearance C may be between 30 mils (762 microns) and 150 mils (3810 microns) when the engine is cold and 0.000 to 80 mils (2032 microns) during operation depending on the specific operating condition and previous rub events that may have occurred. FIG. 3A shows the cross-section along line 3-3 of FIG. 2 with casing 48 and blade 28. FIG. 3A shows porous corrosion resistant aluminum alloy abradable coating 50 on casing 48. Abradable coating 50 is directly deposited on casing 48 by thermal spray and infiltration as discussed below. FIG. 3B shows the cross-section along line 3-3 of FIG. 2 wherein blade 28 is tipped with shroud 28S and knife edge seals 28K.

FIGS. 4, 5A and 5B show a relationship of a stator vane with a rotor. FIG. 4 is a cross-section along line 4-4 of FIG. 1 of casing 48. Vanes 26 are attached to casing 48. In the illustrated two-spool example, coating 60 is on fan hub 11 such that the clearance C between coating 60 and inner diameter (ID) tips 26T of vanes 26 has the proper tolerance for operation of the engine (e.g., to serve as a seal to prevent leakage of air (thus reducing efficiency)) while not interfering with the relative movement of vanes 26 and fan hub 11.

In FIG. 4 and FIGS. 5A and 5B (showing two different vane variations), clearance C is expanded for purposes of illustration. In practice, clearance C may be, for example, in a range of about 20 mils (508 microns) to about 50 mils (1270 microns) when the engine is cold and 0.000 microns to 30 mils (762 microns) during operation depending on the specific operating condition and previous rub events that may have occurred.

FIG. 5A shows the cross-section along line 5-5 of FIG. 4 with casing 48 and vane 26. FIG. 5A shows porous corrosion resistant aluminum alloy abradable coating 60 on fan hub 11. Abradable coating 60 is directly deposited on fan hub 11 by thermal spray and infiltration as discussed below. FIG. 5B shows the cross-section along line 5-5 of FIG. 4 with casing 48 and vane 26 wherein vane 26 is tipped with shroud 26S and knife edge seals 26K.

FIG. 6 is a cross-section along line 6-6 in FIG. 1 which shows fan hub 11 inside fan shroud 13. Fan blades 12A are attached to fan hub 11 and the clearance between fan blades 12A and fan shroud 13 is indicated by C. Abradable coating 70 is on fan shroud 13 such that the clearance between blade tips 12T of fan blades 12 and coating 70 has the proper tolerance for operation of the engine (e.g., to serve as a seal to prevent leakage of air (thus reducing efficiency)) while not interfering with relative movements of the blades in shroud 13. Similar consideration of clearance between fan blades 12 and fan shroud 13 as discussed in FIGS. 2-5B are relevant here.

In an embodiment, corrosion resistant abradable coating is applied to all sealing surfaces discussed. In particular, coating 50 on casing 48, coating 60 on fan hub 11 and coating 70 on fan shroud 13. Casing coatings may be directly on the inner diameter (ID) surface of a structural case (full annulus or segmented) or on ID surfaces of individual blade outer airseal (BOAS) segments (which may be carried in circumferential groups by the structural case) or on an ID surface of a full annulus BOAS. Each full annulus BOAS or BOAS segment group (array) may be associated with a respective blade stage.

As discussed above, a base abradable seal layer is porous aluminum alloy. Exemplary seal material is an aluminum-silicon alloy. A particular example is an aluminum silicon alloy containing about 12 weight percent silicon and the remainder substantially aluminum. The seal material is applied by thermal spray wherein thermal spray may comprise one of flame spray, plasma spray, high velocity oxy fuel (HVOF), or cold spray. Other alloys may include those of the '975 publication.

The porosity comes from a combination of two factors. First, porosity, particularly the interconnected porosity, is created inherently by the spray process by incomplete densification and incomplete bonding between spray particles as they are deposited. Additionally, porosity is introduced by co-spray of the alloy and particles of a fugitive material such as polymethyl methacrylate or polyester. Heat treatment following deposition decomposes the fugitive material and the reaction products escape through interconnected porosity to leave a porous alloy coating layer. When polyester is used, it is often left in the coating as a soft filler material. Even when such filler is left in, the inherent porosity of the spray process allows infiltration of corrosion inhibiting solution as discussed herein.

Figure 7:
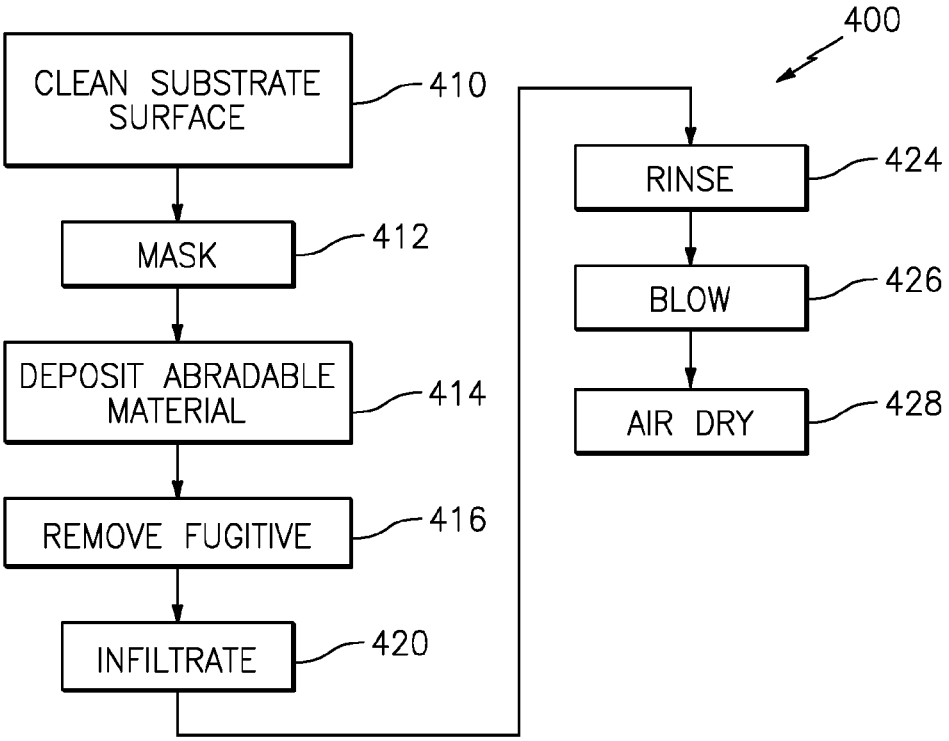
FIG. 7 is a flowchart of a manufacturing process.

A method 400 for forming a corrosion resistant porous aluminum alloy abradable coating is shown in FIG. 7. This starts with a finished substrate (e.g., a finished machined case or rotor component having an exposed alloy surface (typically an aluminum (e.g., 2xxx-, 6xxx-, or 7xxx-series) or titanium alloy (e.g., Ti6Al4V and the like or alternatively stainless steel (e.g., 400-series such as 410)). Exemplary substrates are case segments, blade outer air seals (BOAS), rotor spacers between blade stages, and the like.

The first step 410 in the process is to clean and otherwise prepare the substrate surface. Conventional cleaning and preparation is by methods known to those in the art of thermal and high velocity coating deposition. Processes such as mechanical abrasion through vapor or air blast processes using dry or liquid carried abrasive particles impacting the surface are standard.

Portions not to be coated may be masked 412 such as via masking fixtures, masking tape, or painted on masking material.

Figure 8:
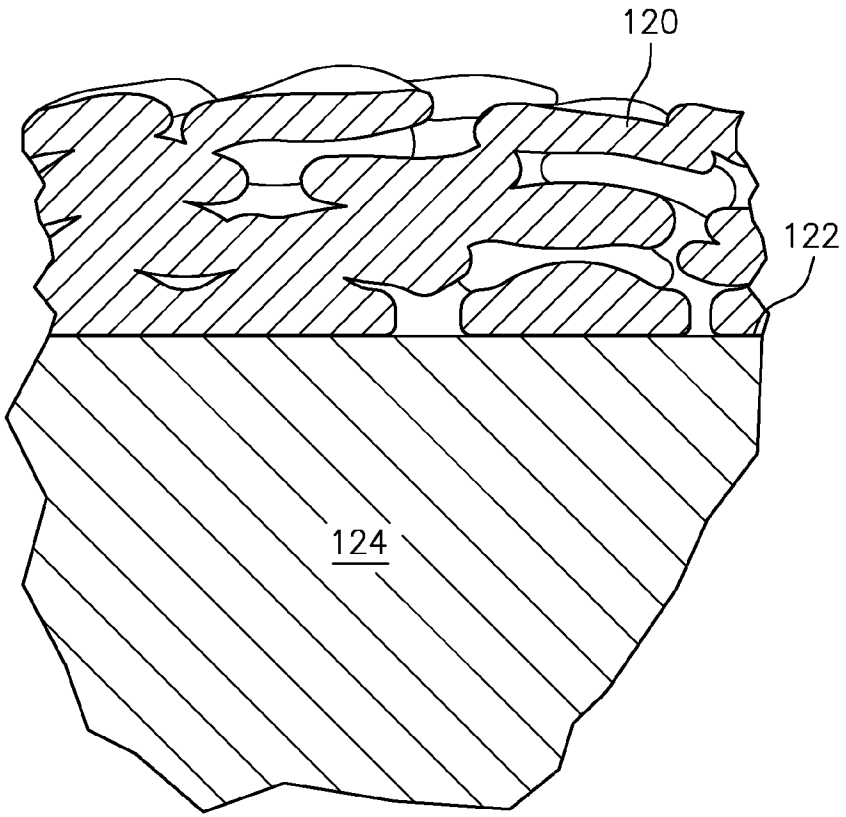
FIG. 8 is a schematic view of a coated substrate prior to infiltration.

The next step is to deposit 414 the base abradable seal material 120 (FIG. 8) to the surface 122 of the metallic substrate 124. This substrate may represent any of the substrates discussed above. This process may be carried out by the co-spray of particles of the aluminum alloy and fugitive polymer particles such as discussed above. An exemplary method of accomplishing this is, for example, to introduce the metal particles and polymer particles into the thermal flame or plume simultaneously during deposition. Although a blend of alloy and fugitive powders may be used, other examples involve separate introduction. For example, the respective position of entrance of the alloy powder and the fugitive powder into the flame may be chosen on the thermal properties of the material. Due to their lower melting points, polymers may be introduced in lower temperature downstream portions of the flame. Metal particles used in this process may have sizes from about 11 microns to about 125 microns and fugitive polymer particles may have sizes from about 25 microns to about 150 microns.

The coating application may occur in one or more spray passes (e.g., with both parts and spray gun being manipulated by robots programmed to provide a desired coating over a desired area).

Post-spray, the fugitive may be thermally and/or chemically removed 416. Exemplary thermal removal is baking in an air circulating oven with afterburner (to clean exhaust gases). Masking may also be removed mechanically or thermally depending on its configuration and composition (e.g., as part of the same removal 416 or a separate step, depending on the nature of the particular masking materials).

A corrosion inhibiting solution may then be infiltrated 420 into the porosity. Post infiltration, there may be a rinse 424 and then a drying. Exemplary drying is a room temperature air blow dry 426 to drive off surface water followed by an ambient air finish dry 428 to fully dry out the porosity.

Figure 9:
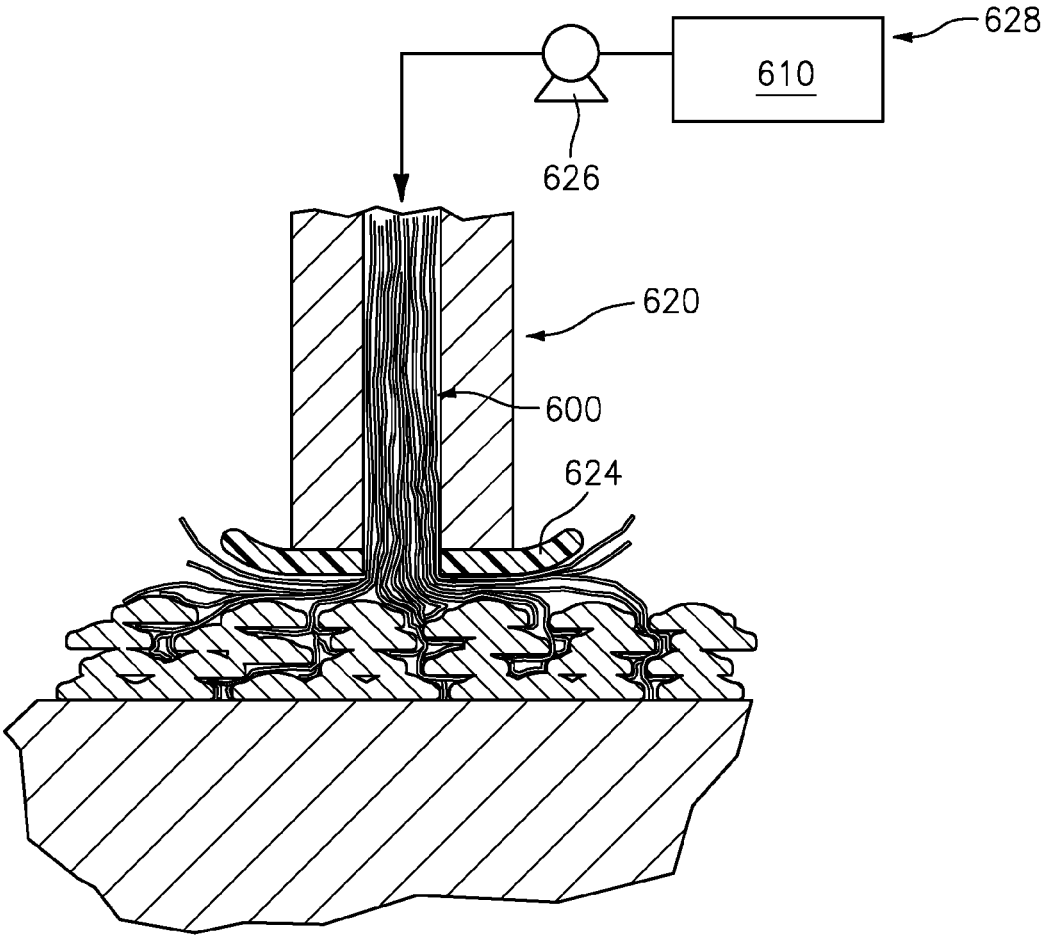
FIG. 9 is a schematic view of a coated substrate during a jet infiltration.

Several examples of infiltration involve impinging of a jet 600 (FIG. 9) from a nozzle 620. The fluid enters the coating at the nozzle and flows laterally through the porosity progressively exiting the coating away from the nozzle (flow through the coating terminating well past the small zone shown in FIG. 9). For example, the part may be fixtured and the nozzle manipulated by an industrial robot to sweep the nozzle over the surface portion to be infiltrated. This sweep may involve multiple successive passes over a given area (e.g., two to twenty or four to fifteen). Each pass may flush out depleted solution from prior passes while replacing it with fresh solution to continue the reaction. This method may provide a benefit with some solution compositions in that depleted solution and other soluble contaminants may be removed by using this same nozzle or jet method with clean rinse water. The pressure and speed of the jet should be effective to provide desired infiltration while not damaging structure. Exemplary supply pressure to the nozzle is 50 psi (0.34 MPa), more broadly, at least 0.050 MPa or 0.050 MPa to 2.0 MPa or 0.20 MPa to 2.0 MPa).

The robot may be programmed to hold the nozzle in close proximity to the surface. Otherwise, the nozzle may include one or more bearings 624 that glide over the surface. The exemplary bearings include lubricious polymer skids and the like. An exemplary skid 624 circumscribes the nozzle exit/outlet with a given span. A pump 626 pumps the solution 610 for the jet 600 through the nozzle from a source 628 (e.g., a tank).

If the nozzle is resiliently mounted, the robot may push the nozzle toward the surface while the pressure of the escaping fluid pushes the nozzle back and forms a fluid film boundary between the nozzle and coating (e.g., like in a fluid film bearing). Force is between nozzle inner area multiplied by fluid pressure and full nozzle face area multiplied by fluid pressure. The polymer bearing material shown would thus be optional to help prevent damage to the coating surface, particularly in transient conditions. With sufficient jet pressure, the robot could be programmed to hold the nozzle outlet several centimeters or more from the surface.

The footprint of the nozzle exit/outlet and the contouring may be configured for particular applications. Exemplary nozzles have outlets with elongate (slot-like) footprints/cross-sections transverse to the flow. For example, when coating a BOAS segment the exit length could correspond to the axial span of the BOAS segment. The outlet width may be much smaller (e.g., of a similar magnitude to the coating thickness). Exemplary nozzle exit aspect rations are from 5:1 to 30:1 or 10:1 to 20:1. Alternative nozzles involve round jets or fanning with droplet sprays. These may be particularly relevant for non-contact situations.

The coating thickness and permeability along with aspects of the jet (and optionally the nozzle) will determine the distribution of flow through the coating. When the nozzle is held back from the surface, the size and velocity of the jet are particularly relevant. For contact or film bearing nozzles held at close proximity, the size of the nozzle exit plus the span of nozzle material surrounding the exit (e.g., bearing(s) 624) are also relevant.

For an example coating of Metco 601 aluminum based abradable at a thickness of 0.200 inch (5.08 mm), an exemplary nozzle has a substantially rectangular exit that is matched in shape to follow the contours of a machined abradable seal, for example in one example of a first stage HPC outer air seal. The nozzle opening is 0.125 inch (3.18 mm) wide and approximately the same length as the axial span of abradable coating it is being used to treat (2.25 inches (5.72 mm)). The nozzle opening is defined by an exit and seal flange (e.g., skid 624). An exemplary flange/skid is 0.125 inch (3.18 mm) wide from the periphery of the exit to the periphery of the flange/skid. That width is a contributor to the fluid force driving the nozzle away from the part.

Solution is provided to the nozzle through tubing. When the nozzle is pressed against the abradable coating, the flow of solution is restricted and pressure rises. The nozzle is allowed to be pushed back from the surface until a back pressure at the nozzle is 50 psi (0.34 MPa). The back pressure is a function of the nozzle configuration, gap to the coating, and solution flow rate. In this exemplary example, a flow rate is controlled to 2.5 gallons per minute (9.5 lpm) and the force of pressing the nozzle to the part is controlled by a pneumatic actuator mounted between the nozzle and robotic manipulator. Back pressure may be measured by a pressure transducer (not shown) mounted near the inlet to the nozzle or further upstream if piping losses are considered. Or it may be calculated based on a force transducer (not shown, e.g., on the robot or end effector/nozzle) measuring force between the nozzle and the workpiece.

The nozzle is moved circumferentially over the coating area (e.g., the frustoconical segment formed by the BOAS ID surface). The rate is 20 inches per minute (8.5 mm/s). The nozzle is passed over all coating regions ten times. Following treatment with the inhibitor solution, rinsing is performed using the same operating parameters and repetitions except using clean rinse water. After treatment the coating may optionally be blown free of liquid and air dried at ambient room conditions. Rapid drying is not necessary because the inner surfaces of the coating are not susceptible to aqueous corrosion.

An alternate example process is to use a non-contact nozzle that is held at 2 inches (5.1 cm) from the coating surface. It is configured to have an elongated exit to cover the axial length of the abradable to be treated and has the same 0.125 inch (3.18 mm) wide opening. Here the nozzle wall thickness and end profile are of lesser importance as they are only involved in establishing the solution jet. Flow rate with this setup is not limited. A high flow capability source is regulated to deliver flow that results in 50 psi (0.34 MPa) back pressure at the nozzle. The nozzle is traversed over the coating surface as in the example above.

Exemplary solution composition is an aqueous solution comprising a source of chromium (e.g., trivalent chromium) and potassium hexafluorozirconate. Particular exemplary chromium sources are chromium sulfate, chromium nitrate, and chromium fluoride or mixtures of more than one. Solutions may be commercially/industrially pure. Additional solution components may include surfactants for facilitating wetting/promoting capillary action within the interconnected aluminum porosity. Such a surfactant may help achieve high/full coverage of the pore surfaces.

The coating reaction involves formation of a corrosion protective layer on the aluminum within the pores and on the surface. The corrosion protection layer comprises oxides of aluminum (from the spray coating), chromium (from the chromium source), and zirconium (from the potassium hexafluorozirconate). There may be a compositional gradient with more aluminum oxide close to the unreacted aluminum alloy and more chromium oxide and zirconium oxide close to the pore surface. Overall in at least some implementations, the aluminum oxide may represent less than half of the oxides by mass or volume and more particularly may be less than each of the other two. The chromium oxide and zirconium oxide may form in a proportion reflecting the chromium and zirconium atomic proportions in the solution. The oxygen for the oxide may come from the water (e.g., with evolution of hydrogen). Other solution components are flushed away in solution or evolved as gases.

The fluorine from the potassium hexafluorozirconate is believed to etch the aluminum surface to activate the surface to render the surface reactive to the other solution constituents to form the protective layer.

A particular exemplary example solution is made from concentrated stock solutions A (chromium source) & B (potassium hexafluorozirconate) mixed and diluted with water. Solution A is composed of 25 g trivalent chromium sulfate, basic in 1000 ml of water (where chromium (III) sulfate, basic is $Cr_4(SO_4)_5(OH)_2$ with 26% $Cr_2O_3$ and 23-24% $Na_2SO_4$). Solution B is composed of 20 g of potassium hexafluorozirconate dissolved in 1000 ml water. The solution used for treatment of the coating is a diluted mixture of these composed of equal parts by volume of Part A and Part B. A concentrate mixture of Parts A and B is then diluted by a factor of nine with water. Such example of a diluted solution contains 200 ppm of chromium (III) and 300 ppm of zirconium. When treating a large number of parts with a single volume of solution that is gradually depleted by reaction with the aluminum, the solution may be kept viable by measuring the ion concentrations and pH and adjusting as necessary with additions of Part A and Part B plus a commonly used acid or base (such as sulfuric acid or sodium hydroxide, respectively) to maintain between 3.3 and 4.0 pH (to avoid precipitation in the bath).

Another exemplary range of such solution is made with a ratio of Part A to part B of 1:2 to 2:1 plus water to achieve chromium (III) concentration of 80-1000 ppm and zirconium concentration of 120-1500 ppm while conforming to the Part A to Part B ratio limits.

Another exemplary range of such solution is made with a ratio of Part A to part B of 1:4 to 4:1 plus water to achieve chromium (III) concentration of 40-2000 ppm and zirconium concentration of 60-3000 ppm while conforming to the Part A to Part B ratio limits. The lower ends of these concentration ranges are based on effectiveness thresholds in testing on monolithic aluminum alloys. The upper ends reflect concerns regarding substrate damage (dissolving/etching of aluminum coating observed). Based upon this, a slightly higher lower end may provide advantageous yields while a lower upper end may provide margins against etching of the aluminum-based coating. The 80 ppm Cr and 120 ppm Zr limits from the range in the previous paragraph are one pair of examples of such lower limits. Another pair is 150 ppm Cr and 200 ppm Zr. At the higher end, the 2000 ppm Cr and 3000 ppm Zr pair is one example. Another is 1200 ppm Cr and 1500 ppm Zr respectively to offer a good margin of safety.

Figure 11:
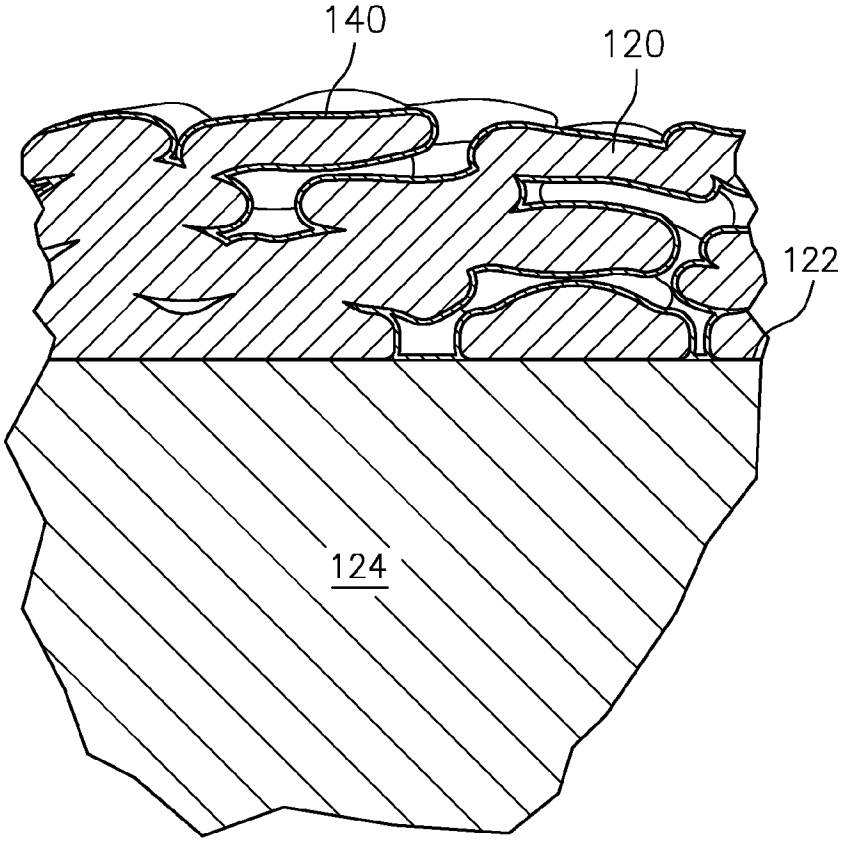
FIG. 11 is a schematic view of a coated substrate after reaction forming a corrosion protection layer.

The solution reacts to form a conversion coating 140 (FIG. 11) as discussed above. Exemplary conversion coating 140 thickness is in the vicinity of 25 nanometers to 30 nanometers, more broadly 20 nanometers to 40 nanometers or 10 nanometers to 80 nanometers or at least 10 nanometers. The result is believed to only slightly reduce porosity if at all. Likely, the porosity will be reduced by no more than 0.5 volume percent or 1.0 volume percent (of total volume not volume of the porosity). The reaction may be facilitated by treatment shortly after coating deposition before atmospheric oxygen and moisture cause excessive passivation of the internal surfaces. In some cases the benefit of baking out the filler to leave more open porosity may outweigh the benefit of having smaller surface oxide and hydroxide thickness. Thus treatment may occur without full bakeout of the filler. After reaction, the part may be installed on the engine. The result is that surfaces within the porosity are coated with the reaction products to improve overall coating corrosion resistance.

By improving the corrosion resistance of the abradable coating, one or more of several benefits may be achieved. Increased time on wing may be achieved between needed service intervals. Stall risks may be reduced.

As noted above, typical use may be in blade outer air seals, particularly in the lower temperature regions of compressor sections. Rotor outer diameter (OD) surfaces interfacing with cantilevered vanes or counter-rotating blade stages may also be implicated. Additionally, radial/centrifugal compressors (e.g., used in auxiliary power units (APU)) may also be implicated.

Figure 10:
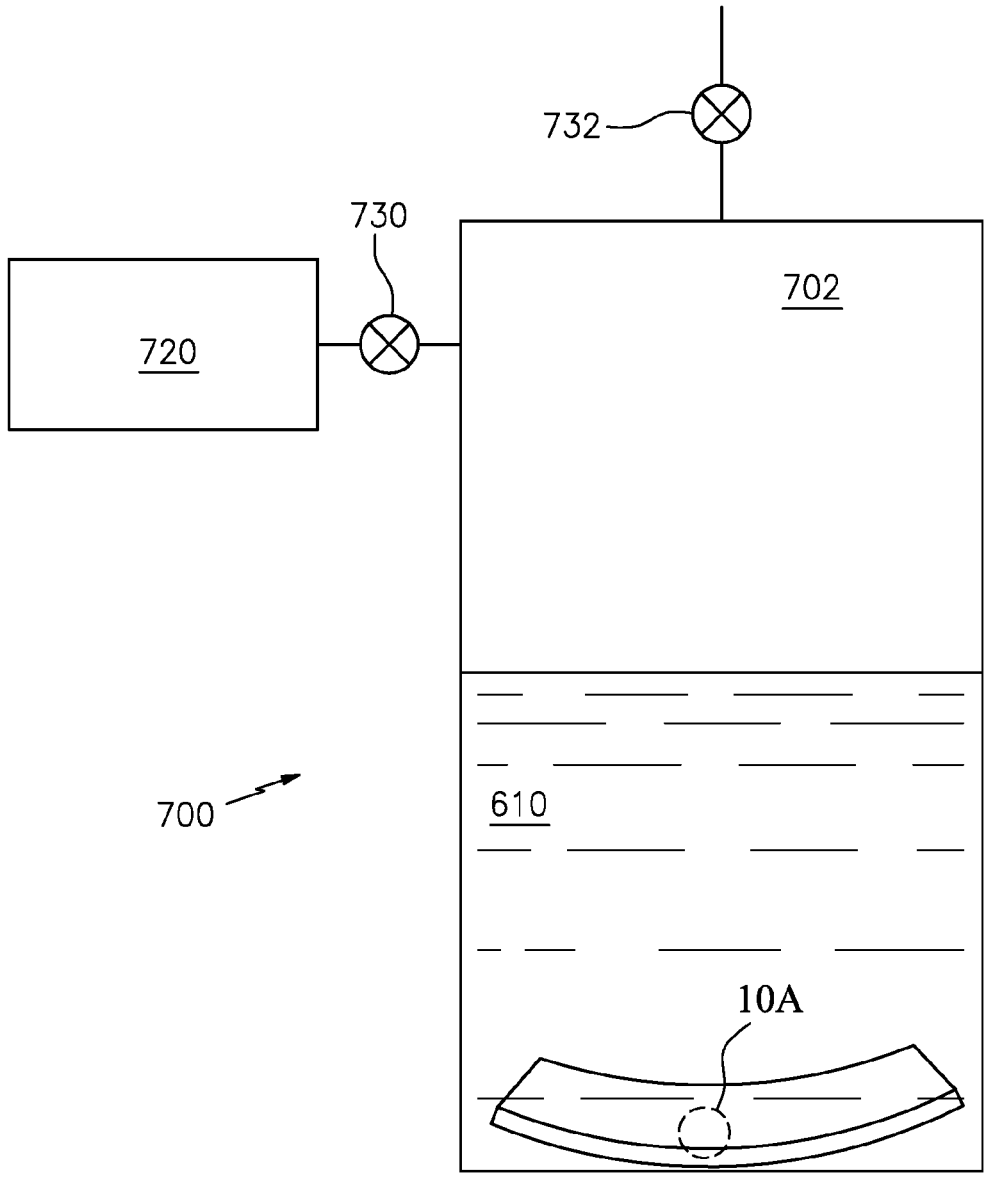
FIG. 10 is a schematic view of a coated substrate during a vacuum immersion infiltration.
Figure 10A:
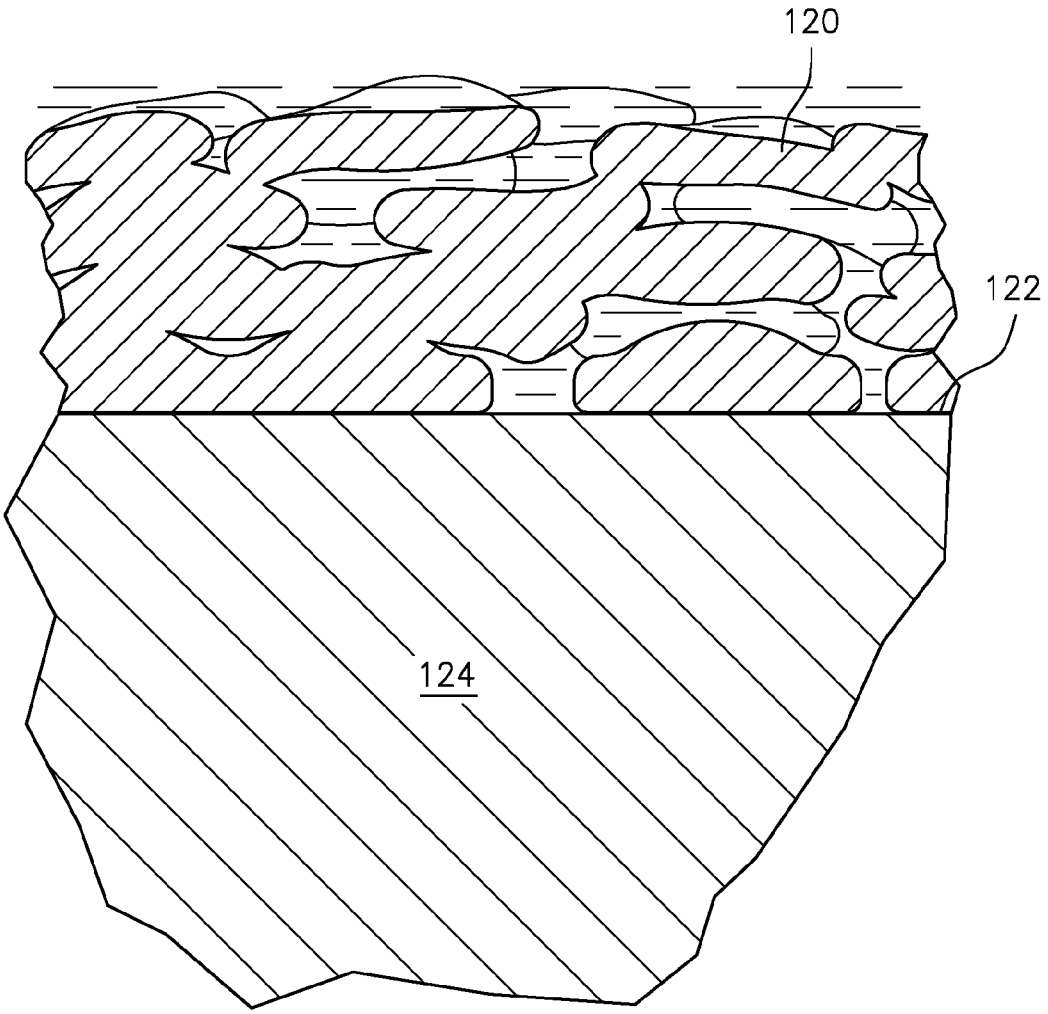
FIG. 10A is a detail cutaway view of the substrate of FIG. 10.

In an alternative implementation, a vacuum infiltration process (replacing the jet impingement) places the part to be processed (e.g., shown as a blade outer airseal segment) in a solution tank 700 (FIGS. 10 and 10A) after the initial aluminum-based layer has been applied optionally with fugitive removed. A vacuum source 720 (e.g., a vacuum pump) may pump down the tank chamber/interior 702 with the aluminum-based layer immersed in the solution 610 (e.g., by a pressure of at least 0.5 bar below ambient, e.g., 0.5 bar to 1 bar below ambient). The pumping down draws out any air from the porosity thus allowing solution to infiltrate (FIG. 10A). After air removal, the vacuum source may be turned off or disconnected (e.g., via valve 730) and the chamber opened (e.g., via valve 732) to atmosphere reestablishing pressure in the headspace of the chamber 702 so that the pressure forces the fluid to further infiltrate the remaining porosity. This may be an iterative process in that a small amount of porosity may remain filled with air, requiring multiple vacuum and release cycles to get full infiltration. Also, the coating may be at least partially dried (not shown (e.g., air dried as in forced air drying 426)) of solution and reinfiltrated to increase the amount of solute available for reaction with the internal surfaces and formation of the conversion coating 140.

The infiltration of solution via jet or vacuum/pressure assist may have one or more benefits relative to hypothetical alternatives. Brush or dip or non-jet low-pressure spray may not have high infiltration, leaving deeper porosity untreated. Also, with such low/no pressure methods capillary action infiltration of the reactants in solution may be inefficient (e.g., even depletion of reactants as the solution moves inward causing reduced quantity of coating 140 progressively inward) and even differential (e.g., differential depletion of reactants as the solution moves inward causing undesirable chemistry and low quantity).

Thus the coating 140 may coat a substantial fraction of the porosity. For example, 98% of the internal surfaces may be effectively treated. The remaining surfaces may not require treatment to provide corrosion resistance as they are effectively protected by being sealed off from the environment by tightly bonded surrounding material. This fraction will depend on the characteristics of the coating which is being treated and the methods used for treatment.

A desirable characteristic of forming the protective conversion coating is that with every iteration of infiltration or time interval of solution flow, the solution is depleted less, resulting in more effective treatment of the most difficult to access internal surfaces. This is in contrast to surface application and capillary action methods that may only effectively treat the first 0.001 to 0.005 inch (25 to 125 micrometers) of the coating.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline component or coating system, details of such baseline may influence details of particular implementations. These may potentially include applications other than abradable coatings. One area is where thin sprayed aluminum alloy coatings (125 to 500 micrometer) are used for dimensional restoration of worn aluminum alloy parts. Although use of laminar jets are discussed, droplet sprays may alternatively be used. Accordingly, other embodiments are within the scope of the following claims.

What is claimed is:

1. A method (400) for applying a coating to a substrate (124), the method comprising:

spraying (414) an aluminum-based coating layer (120) on the substrate; and infiltrating (420) the aluminum-based coating layer with an aqueous solution (610) of:

a source of chromium; and potassium hexafluorozirconate, wherein the aluminum-based coating layer has:

a porosity before infiltration; and a porosity after drying no more than 1% volume percent of the aluminum-based coating layer less than the porosity before infiltration.

2. The method of claim 1 wherein the source of chromium is a source of trivalent chromium.

3. The method of claim 1 wherein the source of chromium comprises at least one of:

chromium sulfate, chromium nitrate, and chromium fluoride.

4. The method of claim 1 wherein:

the infiltrated solution causes a reaction forming oxides of aluminum, chromium, and zirconium.

5. The method of claim 1 wherein the substrate is a turbomachine component and the coating is in sliding engagement with another turbomachine component.

6. The method of claim 1 wherein the infiltrating comprises:

directing a jet (600) of the solution to the aluminum-based coating layer.

7. The method of claim 6 wherein:

the directing comprises sweeping the jet over a surface of the aluminum-based coating layer.

8. The method of claim 6 wherein:

the directing comprises sweeping the jet over a surface of the aluminum-based coating layer from a nozzle (620) sliding along the surface.

9. The method of claim 1 wherein the infiltrating comprises:

vacuum infiltration.

10. The method of claim 1 wherein the aqueous solution comprises:

120-1500 ppm zirconium from potassium hexafluorozirconate.

11. The method of claim 1 wherein the aqueous solution comprises:

80-1000 ppm chromium (III) concentration combined from at least one of chromium sulfate, chromium nitrate, and chromium fluoride.

12. The method of claim 1 wherein the aqueous solution comprises:

80-1000 ppm chromium (III) concentration combined from at least one of chromium sulfate, chromium nitrate, and chromium fluoride; and 120-1500 ppm zirconium.

13. The method of claim 1 wherein:

the substrate is selected from the group consisting of stainless steels, titanium alloys, and aluminum alloys.

14. A method (400) for corrosion protecting an aluminum-based coating (120) on a substrate (124), the method comprising:

infiltrating (420) the aluminum-based coating with an aqueous solution (610) of:

a source of chromium; and potassium hexafluorozirconate, wherein the aluminum-based coating has:

a porosity before infiltration; and a porosity after drying no more than 1% volume percent of the aluminum-based coating less than the porosity before infiltration.

15. The method of claim 14 wherein the source of chromium is a source of trivalent chromium.

16. The method of claim 14 wherein the aqueous solution comprises:

80-1000 ppm chromium (III) concentration combined from at least one of chromium sulfate, chromium nitrate, and chromium fluoride; and, 120-1500 ppm zirconium.

17. The method of claim 14 wherein:

the infiltrating forms a conversion coating (140) comprising oxides of aluminum, chromium, and zirconium.

18. The method of claim 17 wherein:

the conversion coating is 90 to 100 weight percent said oxides of aluminum, chromium, and zirconium.

19. The method of claim 17 wherein:

the substrate is selected from the group consisting of stainless steels, titanium alloys, and aluminum alloys; and the substrate is a turbine engine component.

20. The method of claim 17 wherein:

the substrate is selected from the group consisting of stainless steels, titanium alloys, and aluminum alloys.

* * * * *